US005400483A

United States Patent [19]

Noda

[11] Patent Number: 5,400,483

[45] Date of Patent: Mar. 28, 1995

[54] PLASTIC CLIP

[75] Inventor: Taizo Noda, Nishinomiya, Japan

[73] Assignee: J-Sen Limited, Miyanishi, Japan

[21] Appl. No.: 28,778

[22] Filed: Mar. 9, 1993

[30] Foreign Application Priority Data

Dec. 17, 1992 [JP] Japan ..... 4-356020

[51] Int. Cl.[6] ..... A44B 21/00

[52] U.S. Cl. ..... 24/499; 24/504

[58] Field of Search ..... 24/515, 516, 499, 503, 24/504

[56] References Cited

FOREIGN PATENT DOCUMENTS 51-98462 8/1976 Japan .
56-29525 7/1981 Japan .
1588956 5/1981 United Kingdom .

*Primary Examiner*—James R. Brittain
*Attorney, Agent, or Firm*—David G. Conlin; George W. Neuner

[57] ABSTRACT

The plastic clip comprises a lower clipping member having bridging plate connected integrally to one end of a substrate so as to separate from the substrate and a support shelf formed between a pair of side walls for supporting the bridging plate, and an upper clipping member having a U-shaped auxiliary portion integrally connected with one end of another substrate and a hinge portion formed at a free end of an outer leg of the U-shaped portion. The clip also comprises an operation member having an actuation cam plate inserted between both legs of the auxiliary portion so that ends of the lower clipping member and the upper clipping member are opened and closed with each other when the upper clipping member is assembled into the lower clipping member by inserting the auxiliary portion of the upper clipping member into the gap situated below the bridging plate of the lower clipping member, and fitting the hinge portion of the upper clipping member to the support shelf of the lower clipping member.

9 Claims, 3 Drawing Sheets

PLASTIC CLIP

BACKGROUND OF THE INVENTION

1. Field of the Invention

The present invention relates to a plastic clip, for example, a clip used on clothes such as a suspender clipper or a clip attached to the leading end of a waistcloth for closing a Kimono, or a clothespin.

2. Description of the Related Art

Typical examples of existent plastic clips described above are disclosed in Japanese Patent Publications Sho 56-37801 and Sho 56-29525 invented by the inventor of the present application.

In the plastic clip disclosed in the former publication, without using a conventional metal pin for rotatably supporting a pair of clipping members, a plastic shaft is integrally formed with a clipping member, and the shaft is rotatably fit into a shaft hole formed in another clipping member by utilizing the property of the plastic material, so that the leading ends of the clipping members are opened by the rotational operation of an actuation member put between both of the clipping members at the rear portion of a pin. The plastic clip has a feature capable of eliminating the metal pin.

Further, in the plastic clip disclosed in the latter publication, the above-mentioned shaft is saved, a pair of clipping members are combined by crossing rear portions of the clipping members in a hinged connection structure, and the leading ends of the clipping members are opened by the rotation of an actuation member positioned between the rear portions of the combined clipping members.

However, in any kind of the clips described above, a metal scissor-like spring is disposed to open the leading ends of a pair of clipping members, and the leading ends of the clipping members are always biased resiliently to open under the effect of the scissor-like spring.

Presence of the metal spring gives various undesirable effects as described below.

(1) The spring may possibly be detached from the clip.

(2) Even a stainless steel spring may possibly rust.

(3) The spring requires a structure and a space for mounting and fixing the spring in the clip.

(4) The number of parts is increased and the number of assembling steps is increased as well.

(5) Since the spring responds to a needle inspector for checking whether a needle remains or not in clothes, a clip including the spring can not be subjected, together with clothes, to the needle inspector.

SUMMARY OF THE INVENTION

It is therefore an object of the present invention to provide a clip capable of attaining a required performance, without using any spring, by utilizing the elasticity of a plastic material itself that constitutes a pair of clipping members.

Another object of the present invention is to provide an economical plastic clip having a simple structure and capable of reducing the production cost and the number of assembling steps.

A further object of the present invention is to provide a plastic clip that can be subject to a needle inspecting operation together with clothes, and facilite product administration.

The objects of the invention can be achieved by a plastic clip comprising; a lower clipping member having a pair of side walls connected at one end thereof, respectively, to edges of one end of a substrate, and extended at the other end thereof, respectively, from the substrate substantially in perpendicular to the substrate, a bridging plate integrally connected at both ends thereof, respectively, to the other end of the side walls, and a support shelf disposed below the bridging plate and between both of the side walls, said edges facing each other; an upper clipping member having another substrate, an auxiliary portion having a width narrower than a width defined between both of the side walls of the lower clipping member and formed into a U-shaped configuration, one of legs of a U-shaped auxiliary portion being integrally connected at an upper end thereof with a central portion at one end of the aforementioned another substrate such that the other of the legs protrudes from said one end of the aforementioned another substrate along a longitudinal axis of the aforementioned another substrate, and a hinge portion integrally connected with the other of the legs and tapered toward the one of the legs; and an operation member having a pair of arms each of which has at one end thereof a width capable of being received between both of the legs of said auxiliary portion and which are disposed to face each other, and an actuation cam plate having a length defined between both of the side walls of the lower clipping member and integrally connected at both ends thereof, respectively, to the one end of the arm, the plastic clip being constructed so that the upper clipping member and said lower clipping member are assembled in a state where the other end of the aforementioned another substrate of said upper clipping member and the other end of the substrate of the lower clipping member are opened from each other, by inserting the auxiliary portion of the upper clipping member, from the side of the other end of the substrate beneath the bridging plate of the lower clipping member, fitting the actuation cam plate between both of the legs of the auxiliary portion from the side of one end of the substrate of the lower clipping member while holding the arm of the operation member vertically to the substrate of the lower clipping member, and placing the hinge portion of the upper clipping member on the support shelf, thereby urging the auxiliary portion by the bridging plate, and the aforementioned another substrate of the upper clipping member and the substrate of the lower clipping member are closed at the other ends thereof, by changing the direction of the actuation cam plate by a pivotal operation of the operation member.

The plastic clip according to the present invention is improved with respect to the assembling structure of a pair of clipping members so as to save a spring which was indispensable so far for the construction of a conventional clip, and is constructed so that the clipping members are always biased by utilizing the characteristic of the plastic material to thereby cause the leading ends of the clipping members to be opened without using the spring.

In the clip according to the present invention, and having the foregoing constitution, since the hinge disposed at the rear portion of the upper clipping member is fitted on the support shelf disposed at the rear portion of the lower clipping member forcedly by utilizing the characteristic of the plastic material, the leading ends of both of the upper and lower clipping members are kept in the open state by the elasticity of the plastic material itself, as if a spring were present and, when leading ends in the open state are closed by a hand and then the hand is released from the leading ends, the leading ends can return to the original open state.

That is, the clip according to the present invention can attain the required performance by utilizing the elasticity of the plastic material itself that constitutes a pair of clipping members without using any spring.

Further, since the clip according to the present invention has a structure not requiring a metal spring for opening the leading ends of the clip, there is no worry of causing rust in the spring and, in addition, since there is no requirement of using means for mounting and securing a spring for both of the clipping members, the structure can be simplified. Further, since the number of parts can be decreased, the production cost and the number of assembling steps can be reduced and, accordingly, a great economical merit can be obtained.

Furthermore, since the clip in accordance with the present invention has no metal parts and, accordingly, does not respond to a needle inspector, it can be subjected to needle inspecting operation together with clothes and facilitate the product administration.

Further objects and advantages of the present invention will be apparent from the following description of the preferred embodiments of the invention as illustrated in the accompanying drawings.

DESCRIPTION OF THE PREFERRED EMBODIMENTS

Description will now be made to preferred embodiments of a plastic clip according to the present invention more in details with reference to the accompanying drawings.

Figure 1:
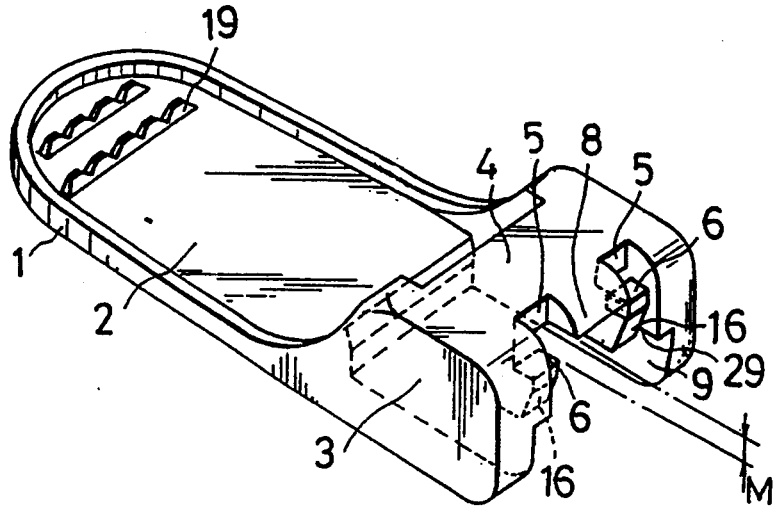
FIG. 1 is a perspective view of a lower clipping member.

FIG. 1 is a perspective view illustrating a lower clipping member of a plastic clip of a first embodiment according to the present invention. The lower clipping member 1 comprises a rectangular substrate 2 having one end formed generally in an arcuate shape, and a pair of side walls 3 integrally connected, respectively, to edges that face each other at the other end of the substrate 2. Each of the side walls 3 is extended from the substrate 2 substantially perpendicular to the substrate 2, and a bridging plate 4 is integrally connected to the upper ends of the side walls 3. As can be seen from FIG. 4, a gap 7 is formed below the bridging plate 4.

Figure 4:
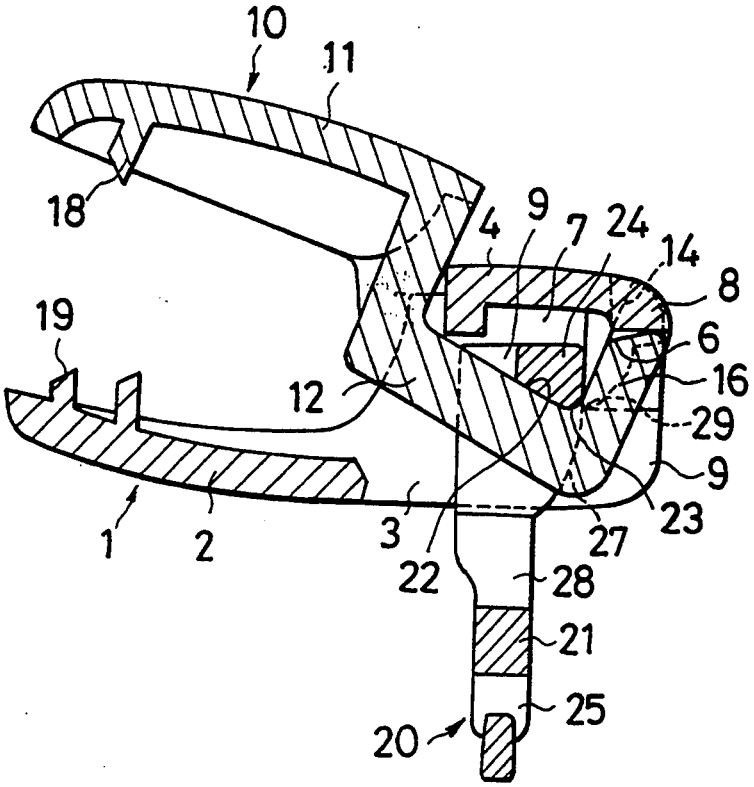
FIG. 4 is a longitudinal cross sectional view in a central portion of a clip in an open state.

Recesses 5, 5 each having a predetermined width are formed to an edge region of the bridging plate 4 situated on the side opposite to the arcuate end of the lower clipping member 1 such that a pent roof 8 is left in a central portion of the edge region. A pair of support shelves 6, 6 that protrude inward from the inner surfaces of both of the side walls 8, 8 are disposed just below the recesses 5, 5, respectively. As shown in FIG. 4, rectangular notch surfaces 9 that extend downward and in the direction opposite to the arcuate end of the lower clipping member 1 are formed on the inner surfaces of both of the side walls 3, 3. Reference numeral 19 denotes clipping teeth disposed on the upper surface of the substrate 2 in the vicinity of one end of the substrate 2.

Figure 2:
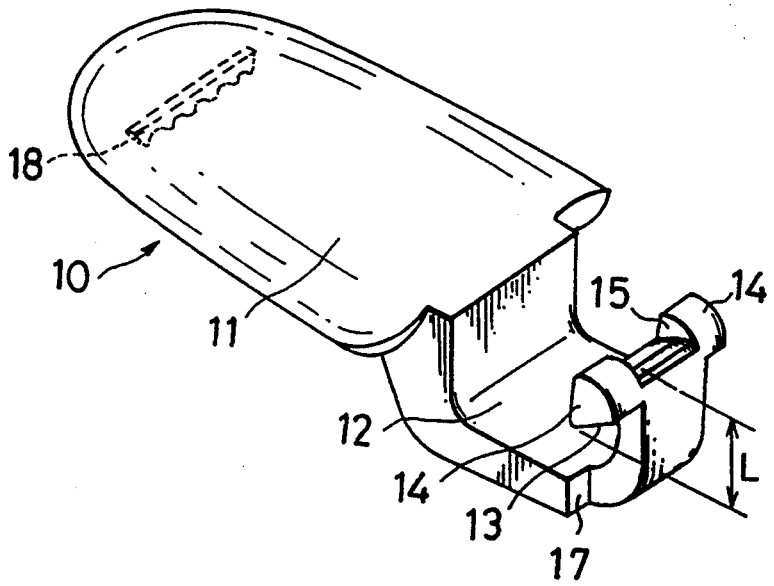
FIG. 2 is a perspective view of an upper clipping member.

FIG. 2 is a perspective view illustrating an upper clipping member made of a plastic material that constitutes a clip according to this embodiment. An upper clipping member 10 comprises a substrate 11 having a leading end formed on the side of one end of the substrate 11 generally in an arcuate shape and configurated substantially in symmetry with the lower clipping member 1. An auxiliary portion 12 is integrally connected to a central portion on the other end edge of the substrate 11. The auxiliary portion 12 has a width narrower than the width defined between both of the side walls 3, 3 of the lower clipping member 1, and has a U-shaped configuration. One of legs of the U-shaped portion constituting the auxiliary portion 12 is connected with the other end of the substrate 11, and a pair of hinges 14, 14 each having such a width that can fit into each of the recesses 5, 5 of the lower clipping member 1 and each having a sector-like cross section are respectively connected integrally to both side portions at the upper end of the other of the legs. Each of the hinges 14, 14 has a slope 13 extending to the bottom of the auxiliary portion 12.

The hinges 14, 14 define a recess 15 therebetween so as to receive the pent roof 8 of the lower clipping member 1. The bottom surface of the recess 15 has a convex shape in which,an outer portion of the bottom surface is higher than an inner portion of the bottom surface, and the vertical size L between the top surface of the convex shape and the leading end of the hinge 14 is made slightly greater than the vertical size M between the lower surface of the pent roof 8 of the lower clipping member 1 and the upper surface of the support shelf 6.

Accordingly, when the upper clipping member 10 is assembled into the lower clipping member 1 by inserting the auxiliary portion 12 of the upper clipping member 10 from the side of the arcuate leading end of the lower clipping member 1 into the gap 7 below the bridging plate 4 and mounting the lower surfaces of the hinges 14, 14 on the upper surfaces of the support shelves 6, 6 as shown in FIG. 4, since the crest of the convex-shaped bottom surface of the recess 15 of the upper clipping member 10 is urged by the lower surface of the pent roof 8 of the lower clipping member 1 due to the difference between the size M and L, the hinges 14, 14 are inclined toward the outside of the auxiliary portion 12, with the gap between the rear part of the slope 13 that descends forward of the hinges 14, 14 and the support shelf 6 acting as a relief, and the leading end of the upper clipping member 10 is kept in the open state as shown in FIG. 4.

Reference numeral 17 denotes a notch formed at the bottom of the auxiliary portion 12 and 18 denotes clipping teeth disposed on the lower surface in the vicinity of one end of the substrate 11.

Figure 3:
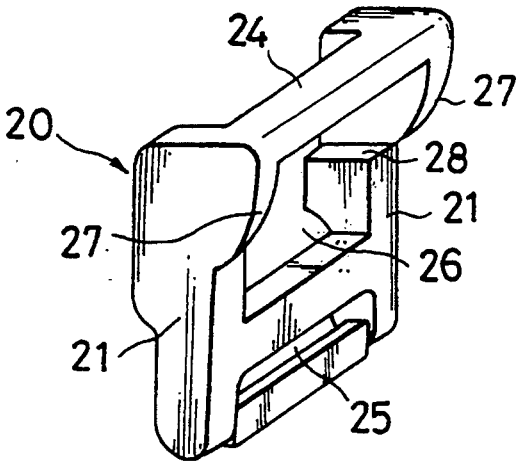
FIG. 3 is a perspective view of an operation member.

FIG. 3 is a perspective view of a plastic operation member for constituting a clip according to this embodiment. The operation member 20 comprises a pair of arms 21, 21 arranged to face each other and an actuation cam plate 24 connected integrally at both ends thereof to the upper ends of the arms 21, 21, respectively. Each of the arms 21, 21 has a widened upper end, and one of edges in the upper end portions of each of the arms 21, 21 is formed into a J-shaped configuration. As shown in FIG. 4, the actuation cam plate 24 has a laterally elongate cross section, lateral sides of the cam plate 24 facing each other intersect substantially in perpendicular with the upper surface of the cam plate 24, the surface of the cam plate 24 opposing to the upper surface is formed so as to have a slope 22 that descends backward, and the edge 23 of the actuation cam plate 24 at which edge the lateral surface of the cam plate 24 formed into the J-shaped edge 27 intersects the slope 22 is formed into an arcuate shape. A slit-like belt-insertion 25 is disposed in the lower end portion of the operation member 20. In the drawing, reference numeral 28 denotes protrusions disposed on the inner surface of the arms 21, 21 so as to abut the protrusions against the notches 17, 17 of the auxiliary portion 12 at a time when the operation member is rotated in clock-wise direction.

A window 26 is formed below the actuation cam plate 24 so that the arms 21, 21 can enter the space defined between the inner surfaces on both of the side walls 3, 3 of the lower clipping member 1, while the actuation cam plate 24 can fit in a space defined between the two legs that constitute the auxiliary portion 12 of the upper clipping member 10, and the operation member 20 can rotate by about 90°.

There are no particular restrictions on the plastic material forming each of the members used for the clip in this embodiment, but a polycarbonate is desirable in view of elasticity and durability.

Each of the members constituting the clip in this embodiment is assembled as described below.

The auxiliary portion 12 of the upper clipping member 10 is inserted from the side of the arcuate leading end of the lower clipping member 1 into the gap below the bridging plate 4 of the lower clipping member 1, the actuation cam plate 24 is fitted between both of the legs of the auxiliary portion 12 of the upper clipping member 10, while holding the arms 21, 21 of the operation member 20 vertically to the lower clipping member 1, and the lower surfaces of the hinges 14, 14 of the upper clipping member 10 are placed on the support shelves 6, 6. In this instance, the widened portion at the upper ends of the arms 21, 21 also fit on the notch surfaces 9, 9 formed on the inner surfaces of the side walls 8, 3, simultaneously. Although a large resistive force is encountered upon performing the fitting operation described above, since the upper portion of the inner side of the hinge 14 moves while sliding on the slope 16 formed below the support shelf 6 (elasticity of the plastic material exerts in this case), the hinge 14 fits on the support shelf 6.

In this instance, since the size L between the lower end of the hinge 14 of the upper clipping member 10 and the crest of the convex-shaped bottom surface of the recess 15 is made slightly greater (by about 1.5 mm) than the size M between the lower surface of the pent roof 8 of the lower clipping member 1 and the upper surface of the support shaft 8, the crest of the convex-shaped bottom surface of the recess 15 is always urged by the lower surface of the pent roof 8, so that the leading end of the upper clipping member 10 is kept in the open state as shown in FIG. 4.

In the state where the leading end of the upper clipping member 10 is kept open as described above, the arm 21 of the operation member 20 is in a vertical state, that is, the actuation cam plate 24 disposed at the upper end portion of the operation member 20 is put, in a laterally elongate state as viewed from the lateral direction, between both of the legs of the auxiliary plate 12 of the upper clipping member 10 and between the notch surfaces 9, 9 formed on the inner surfaces of both of the side walls 3, 3 of the lower clipping member 1.

Figure 5:
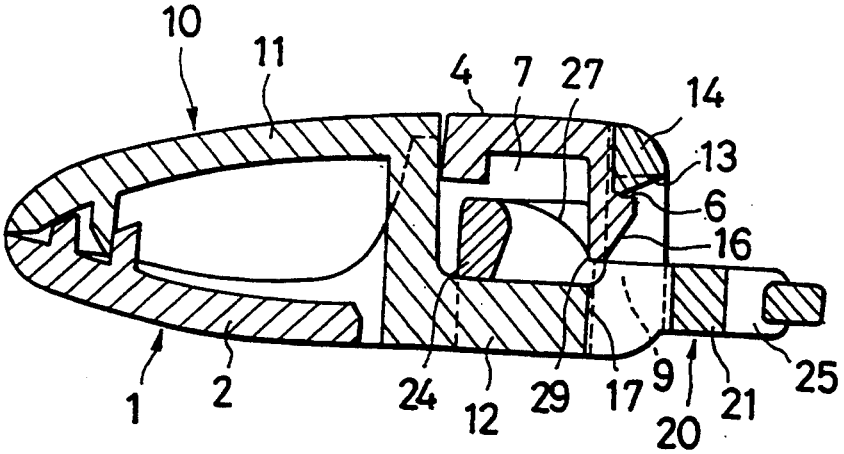
FIG. 5 is a longitudinal cross sectional view in a central portion of a clip in a closed state, which is a view also illustrating a state of a hinge and a supporting shelf in an open state.

When the arm 21 vertical to the lower clipping member 1 is rotated counter clockwise from the state in which the upper clipping member 10 is kept open as shown in FIG. 4 into a horizontal state as shown in FIG. 5, since the J-shaped portion 27 of the arm 21 and the shoulder 29 disposed on the inner surface of the side wall 3 are engaged, the upper end portion of the arm 21 rotates while moving forward, while the actuation cam plate 24 which is laterally elongate as viewed from the lateral direction, also rotates by 90° and, at the same time, displaces slightly forward into a longitudinally elongate shape to widen the gap between the bridging plate 4 and the bottom of the auxiliary portion 12, the leading end of the upper clipping member 10 is lowered to close the opening.

Upon rotational operation of the operation member 20 as described above, the upper clipping member 10 rotates counter clockwise in FIG. 4 around a point of contact between the leading end of the hinge 14 and the support shelf 6 as a fulcrum, whereby the crest of the convex-shaped surface formed at the upper end of the lee of the auxiliary portion 12 urges the lower surface of the pent roof 8. The urging force is absorbed by the plasticity of the plastic material of the pent roof 8 and a portion of the bridging plate 4 situated in front of the pent roof 8.

On the other hand, when the operation member 20 is rotated clockwise by 90° to raise the arm 21 vertically relative to the lower clipping member 1 as shown in FIG. 4, since the actuation cam plate 24 slightly displaces backward into a laterally elongate shape contrary to the operation as described above, the leading end of the upper clipping member 10 turns again into the open state under the effect of the reaction against the force urging the pent roof 8 so far.

Figure 6:
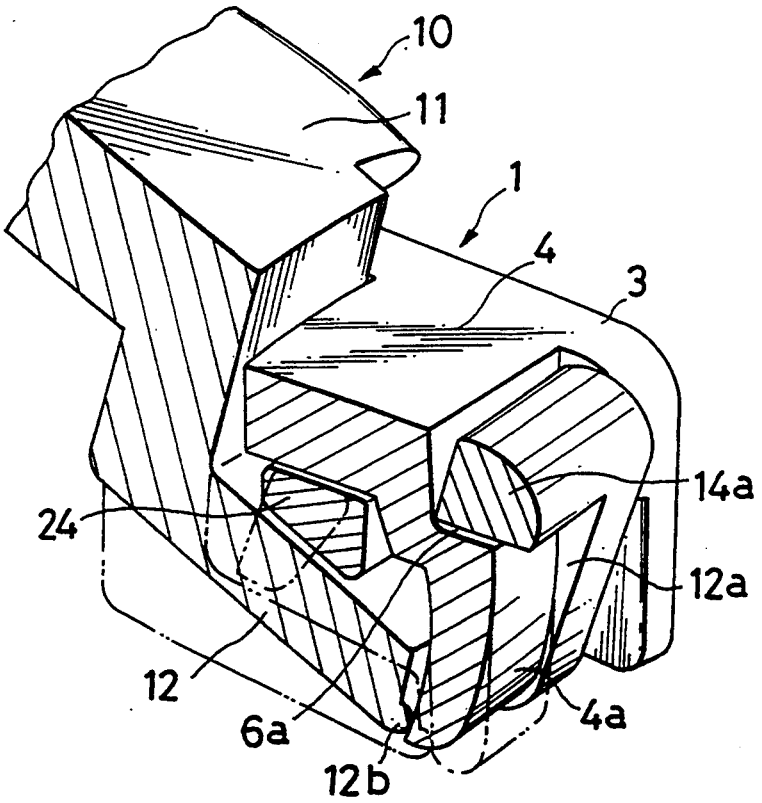
FIG. 6 is a fragmentary cross sectional view in a central portion of a clip, which illustrates an open state of the clip in another embodiment.

FIG. 6 shows an open state of a clip in a second embodiment of the clip according to the present invention, which is a fragmentary cross sectional view in a central portion of the clip. The constitution is basically identical with that for the first embodiment, expect that the clip in this embodiment is different from the first embodiment, regarding the structure of a hinge disposed at the rear end of an upper clipping member 10 and an urging portion in which the upper clipping member 10 is urged by a lower clipping member 1 when the upper clipping member 10 is assembled into the lower clipping member 1.

That is, in the clip shown in FIG. 8, a tongue **4*a* having a width narrower than a gap between both side walls 3, 3 is integrally connected with a central portion of the rear end edge of the bridging plate 4 disposed on the rear portion of the lower clipping member 1, a support shelf 6*a* having a predetermined width is disposed in a central portion of the upper end of the tongue 4*a*, while a window 12*a* for receiving the tongue 4*a* is formed in a rear leg of an auxiliary portion 12 of the upper clipping member 10, and the upper edge portion of the window 12*a* is provided with a hinge 14*a*** having a sector-like cross section.

The tongue **4*a* at the rear end of the lower clipping member 1 is formed in such a manner as to slightly incline forward at the lower end thereof, while a laterally elongate bulgy portion 12b is formed to the bottom of the window 12a disposed at the rear end of the upper clipping member 10. When the upper clipping member 10 is assembled into the lower clipping member 1, the bulgy portion 12b is in press contact with the inner surface of the lower end of the tongue 4a. Then, in a state where the auxiliary portion 12 of the upper clipping member 10 is inserted below the bridging plate 4 of the lower clipping member 1, the bulgy portion 12b interferers with the inner surface of the lower end of the tongue 4a as shown by the dotted lines in FIG. 6**.

Description will now be made to the assembling of each of the members that constitutes the clip in this embodiment.

The rear end portion of the U-shaped auxiliary portion 12 of the upper clipping member 10 is inserted from the side of the arcuate leading end of the lower clipping member 1 into a gap below the bridging plate 4 of the clipping member 1, and the lower surface of the hinge 14a disposed at the rear end of the upper clipping member 10 is placed on the support shelf 6a in a state of holding the arm 21 of the operation member 20 vertically relative to the lower clipping member 1, putting the actuation cam plate 24 from the rear side of the lower clipping member 1 to a position between the bottom of the auxiliary portion 12 and the bridging plate 4 as shown in FIG. 6 and, at the same time, inserting the tongue 4a to the window 12a.

When the hinge 14a is fitted on the support shelf 6a, a large resistive force is encountered because of the interference between the inner surface of the lower end portion of the tongue 4a and the bulgy portion 12b disposed at the bottom of the window 12a, but the hinge 14a fits onto the support shelf 8a while sliding along the rear face of the tongue 4a under the effect of the elasticity of the plastic material.

In a state where the upper clipping member 10 is fitted into the lower clipping member 1 as shown in FIG. 6, the bulgy portion 12b is always urged in the direction of the arcuate leading end of the upper clipping member 10 by the lower end of the tongue 4a, so that the arcuate leading end of the upper clipping member 10 is kept in an open state.

When the arm 21 of the operation member 20 perpendicular to the lower clipping member 1 is rotated counter clockwise from the state, shown by the solid line in FIG. 8, in which the upper clipping member 10 is kept open, into a state in which the arm 21 is horizontal, like the case of the first embodiment, the upper end of the arm 21 rotates while moving toward the arcuate leading end of the lower clipping member 1 by the engagement between the J-shaped portion 27 of the arm 21 and the shoulder 29 disposed on the inner surface of the side walls 3, 3, and the actuation cam plate 24 in a laterally elongate state as viewed from the lateral direction also rotates by 90° and, at the same time, displaces slightly toward the arcuate leading end mentioned above into a longitudinally elongate state as shown by the dotted chain to enlarge the gap between the bridging plate 4 and the bottom of the auxiliary portion 12. Accordingly, the arcuate leading end of the upper clipping member 10 is lowered to close the opening.

In this state, the upper clipping member 10 rotates counter clockwise around the point of contact between the leading end of the hinge 14 and the support shelf 6 in FIG. 6 and the bulgy portion 12b urges the inner surface at the lower end of the tongue 4a as shown by the dotted chain. The urging force is absorbed by the elasticity of the plastic material of the tongue 4a and the bridging plate 4 situated above the tongue 4a.

On the other hand, when the operation member 20 is rotated by 90° thereby positioning the arm 21 perpendicularly to the lower clipping member 1, since the actuation cam plate 24 displaces slightly in the direction opposite to the arcuate leading end, contrary to the operation as described previously, into a laterally elongate state as shown by the solid line, the arcuate leading end of the upper clipping member 10 turns again into the open state under the effect of the reaction against the force urging the inner surface at the lower end portion of the tongue piece 4a so far.

The position of urging the upper clipping member 10 by the lower clipping member 1 in the clip as described above is not restricted to the portion as described for the first or second embodiment. The upper clipping member 10 may be urged in the direction where the arcuate leading end of the clipping member 10 opens while centering around the leading end of the hinge 14, that is, in the clockwise direction at a position on a lower surface of the bottom portion of the auxiliary portion 12 of the upper clipping member, at which portion an optional coaxial circle centering around the leading end of the hinge or 14a intersects with the lower surface of the bottom portion, such that the hinge does not come off the support shelf 6 or 6a.

Further, in the clip according to the present invention, since the lower clipping member 1 and the upper clipping member 10 intersect in a X-like configuration in their rear half portions and the fulcrum of the hinges is situated near the rear end of the lower clipping member 1, the opening can be made large relative to the entire length of the clip.

Many widely different embodiments of the present invention may be constructed without departing from the spirit and scope of the present invention. It should be understood that the present invention is not limited to the specific embodiments described in the specification, except as defined in the appended claims.

What is claimed is:

1. A plastic clip constructed and arranged to eliminate use of a metal spring member, the clip comprising:

a lower clipping member comprising a pair of side walls opposing each other with a space therebetween, a first gripping plate integrally connected to and extending from a lower portion of a side edge of each of the side walls, a bridging plate integrally connected to and extending between the top edges of the side walls, and a support surface located between the side walls below the bridging plate;

an upper clipping member comprising a U-shaped member comprising a bottom plate integrally connected to two side plates extending upward from opposing edges of the bottom plate in a U-shaped configuration, a second gripping plate integrally connected to and extending from the top edge of one side plate in a direction away from the other side plate, the U-shaped member having dimensions to fit between the side walls of the lower clipping member to oppose the first and second gripping plates, a pivot member integrally connected to and located at the top portion of the other side plate, the pivot member being constructed and arranged to work with the support surface in opening and closing the opposed gripping plates; and an operation member comprising a pair of opposing arms, the arms being spaced apart and integrally connected at one end by an actuation cam plate extending between the arms, the operation member having dimensions to fit between the side walls of the lower clipping member with U-shaped member of the upper clipping member between the arms and the actuation cam plate between the side plates of the U-shaped member, the plastic clip being constructed and arranged so that, when the lower clipping member, upper clipping member and operation member are assembled with the operation member extending substantially perpendicular to the first gripping plate, the first and second gripping plates are normally apart and that, when the operation member is pivoted about 90° to a position substantially parallel to the first gripping plate, the first and second gripping plates are closed together to grip a material placed between them.

2. A plastic clip as set forth in claim 1, wherein the bridging plate contains a pair of recesses formed in the edge opposite the edge facing the first gripping plate, the support surface comprises a shelf member integrally attached to the inner surface of each side wall, one located below each recess, and the pivot member comprises two pivot blocks, each integrally connected to and extending from one side of the other plate member of the upper clipping member, the pivot members having dimensions to fit into the recesses.

3. A plastic clip as set forth in claim 2, wherein the recesses in the bridging plate define a pent roof portion therebetween, the two pivot blocks forming a gap having a dimension to receive the pent roof portion, wherein the bottom of the gap is defined by the top edge of the other side plate, which top edge is convex-shaped wherein the portion of the convex-shaped top edge toward the outside of said other side plate is higher than the portion toward the inside, and the vertical distance between the crest of the convex-shaped top edge and edge of the pivot block that contacts the support surface is greater than the vertical distance between the lower surface of the pent roof portion and the support surface.

4. A plastic clip as set forth in claim 1, further comprising a tongue member integrally connected to a central position at the edge of the bridging plate opposite the edge facing the first gripping plate, the tongue member having a width narrower than the distance between the side walls and extending down between the side walls and substantially perpendicular to the bridging plate, wherein the support surface is formed integrally in the tongue member, the tongue member having dimensions to be received within the U-shaped member of the upper clipping member, the other side plate having an .opening therein to receive the tongue member, and the upper edge of the other side plate having a pivot member with a sector-shaped cross section integrally connected thereto and dimensioned to be received on the support surface.

5. A plastic clip as set forth in claim 4, wherein the tongue member is formed so that the lower end is inclined toward the first gripping plate, the U-shaped member further has a protrusion on the outer surface of the other side plate at the lower side of the opening therein, the protrusion urging the tongue member away from the first gripping plate when the paper clip is assembled.

6. A plastic clip as set forth in claim 5, wherein each of the lower clipping member, upper clipping member and operation member is formed of polycarbonate.

7. A plastic clip as set forth in any one of claims 1–4, wherein an opening defined between the two arms and having the actuation cam plate on one end is dimensioned and sized so that the operation member can be rotated 90° when the actuation cam plate is in a space defined between the two side walls of the lower clipping member and the two side plates of the U-shaped member of the upper clipping member, when the plastic clip is assembled.

8. A plastic clip as set forth in claim 7, wherein the actuation cam plate has a cross-section so that, when arranged perpendicular to the first gripping plate in the assembled paper clip, the lower surface of the cam plate diverges away from the top surface of the cam plate, as the lower surface extends away from the first gripping plate, and curves to join with the side surface opposite the first gripping plate.

9. A plastic clip as set forth in claim 8, wherein each of the lower clipping member, upper clipping member and operation member is formed of polycarbonate.

* * * * *